United States Patent [19]

Reil et al.

[11] Patent Number: 4,713,048

[45] Date of Patent: Dec. 15, 1987

[54] PROCESS FOR THE PRODUCTION OF A LIQUID PACKAGE AND APPARATUS FOR IMPLEMENTATION OF THE PROCESS

[75] Inventors: Wilhelm Reil, Bensheim; Ulrich Deutschbein, Mühltal, both of Fed. Rep. of Germany

[73] Assignee: Tetra Pak Finance & Trading S.A., Pully, Switzerland

[21] Appl. No.: 903,370

[22] Filed: Sep. 3, 1986

[30] Foreign Application Priority Data

Sep. 5, 1985 [DE] Fed. Rep. of Germany ..... 3531663

[51] Int. Cl.[4] ..... B31B 1/16; B31B 1/28

[52] U.S. Cl. ..... 493/74; 493/87; 493/105; 493/176; 493/302; 493/466

[58] Field of Search ..... 493/105, 133, 147, 152, 493/176, 74, 157, 180, 287, 302, 466, 87

[56] References Cited

U.S. PATENT DOCUMENTS

| | | | |
|---|---|---|---|
| 369,638 | 9/1887 | Godfrey et al. | 493/466 |
| 3,035,288 | 5/1962 | Pecoulos | 493/455 |
| 3,628,428 | 12/1971 | Peacock | 493/105 |
| 3,733,980 | 5/1973 | Palmer et al. | 493/176 |
| 4,072,549 | 2/1978 | Amberg et al. | 493/74 |
| 4,121,402 | 10/1978 | Cress et al. | 493/302 |
| 4,311,476 | 1/1982 | Williams | 493/176 |
| 4,540,391 | 9/1985 | Fries, Jr. | 493/287 |
| 4,604,850 | 8/1986 | Reil | 53/423 |

*Primary Examiner*—Frederick R. Schmidt
*Assistant Examiner*—William E. Terrell
*Attorney, Agent, or Firm*—Biebel, French & Nauman

[57] ABSTRACT

A method and apparatus are disclosed for production of containers for packaging liquids. Plastic-coated supporting material is drawn as a web from a supply roll in a first direction along a web path. At a first position, the web is cut into sheets. The sheets are conveyed along a transport path in a second direction transverse to the web path. At a second position, each sheet is partially shaped into a tube, and an edge of the sheet is folded over and sealed. At a third position, shaping is completed to cause the side edges of the sheet to join, and the tube side is sealed. A plastic lid is molded onto the top of each tube, and the bottom end is folded and sealed into a quadrilangular bottom.

6 Claims, 10 Drawing Figures

PROCESS FOR THE PRODUCTION OF A LIQUID PACKAGE AND APPARATUS FOR IMPLEMENTATION OF THE PROCESS

BACKGROUND OF THE INVENTION

The invention relates to a process for the production of a liquid package, the tube-shaped side walls of which consist of supporting material, e.g. paper or board, coated with plastic, the bottom of which is quadrangular and produced by folding and sealing and the lid of which, consisting only of plastic and having an opening device, is moulded onto the upper edge of the tube forming the side walls; this involves the coated paper for the tube being drawn off a supply roll in web form, cut into sheets and shaped into the tube, after which the lid is moulded on and the bottom is folded and closed.

The invention also relates to an apparatus for the production of such a liquid package with a supply roll, conveying mechanisms for the paper web, cutting mechanisms for the separation of the web into sheets, tube-shaping mechanisms and conveying mechanisms for the sheets to further work stations.

Liquid packages of the type described at the start are already known. The lid consisting only of plastic may in this case be of quadrangular or round design in cross-section or plan view. In side-view, the lid may be flat like a disc, or else of a design provided with a truncated cone-shaped portion.

In the case of known production processes, the supporting material web, coated at least on one side with plastic, referred to hereafter as paper web, is drawn off a supply roll and fed in this draw-off direction, which is the same as the further conveyance direction, to further work stations, e.g. for cutting, shaping of a tube and closing. It goes without saying that the tube is closed by a longitudinal sealed seam. In the case of the liquid packages which are produced by the known processes, the longitudinal sealed seam, and thus also the longitudinal centre line of the tube lies not only in the general conveyance direction but thus also in the direction of the paper fibres, since generally with a roll the paper fibres always lie in the longitudinal direction of the web. The apparatuses, processes and liquid packages according to the invention which are considered are understood as operating from a roll.

The position of the paper fibres in the longitudinal direction of the tube, i.e. in the direction of the longitudinal sealed seam, makes a package of elongated configuration, in which for example one or two liters of milk are packed, transported and offered to the final consumer, have a certain softness of the side walls, which although not very troublesome or awkward in use, would nevertheless be gladly avoided by the producer.

Furthermore, as well as the constant demand for good tightness of the liquid package, there is always the consideration of edge protection at the longitudinal sealed seam. A paper web can, namely, be shaped into a tube and closed by means of its longitudinal sealed seam in such a way that the two free longitudinal edges of the web are sealed by laying them so that they overlap or inside on inside. The forces occurring due to the filled product are better absorbed by the sealed seam produced by overlapping. In this case, however, a cut edge protrudes inside the package, the plastic coating being severed by the cut or else the supporting material, preferably the paper, being exposed to the filled product at the cut edge. The liquid can penetrate into the paper fibres, soften them and destroy the package. Therefore, a separate strip is laid along the inside of the overlapping sealed seam as edge protection. It goes without saying that the laying on of a special strip is gladly avoided, especially as other sealing strips are also laid on in particularly critical folding regions and the like.

In the case of the other type of sealed seam, in which the strip-shaped ends are joined or sealed to each other inside to inside, the compressive forces of the filled product to the outside can induce an impairment and a breaking open of the sealed seam.

These problems were known to package producers, which is why a butt sealed seam has also already been provided, which is however inconvenient. Furthermore, the liquid package represents a mass product, so that it would be expedient for the producer of the package and also the packing company for the liquid to have high-capacity machines, the capacity of which is above that of conventional machines.

SUMMARY OF THE INVENTION

The problems mentioned above are solved according to the invention for the process for production of the liquid package in that the conveyance direction of the separated paper sheets is provided transverse to the feed direction of the paper web before the separation (first position) into sheets and in that, in shaping of the tube and production of the longitudinal sealed seam, a strip-shaped end, joined to the sheet via a folding edge, is formed, folded over by 180° about the folding edge and sealed onto the sheet outer surface, after which the opposite, free end of the sheet is sealed onto this strip-shaped end, forming the longitudinal sealed seam.

The first measure means the arrangement of the paper fibre direction transverse to the longitudinal sealed seam or else transverse to the longitudinal extent of the tube. It has been shown in an advantageous way that the finished package with transversely running paper fibre direction has a higher rigidity when seized by the end user than that of the longitudinally running paper fibre direction, and can even be up to twice the rigidity compared with the longitudinally running paper fibre direction.

By the further measure according to the invention, involving folding over the strip-shaped end onto the neighbouring outer surface of the sheet, and by the subsequent sealing on of the opposite free end of the sheet, a new design of the longitudinal sealed seam is created in which neither the edge protection mentioned, nor the longitudinal sealed seam involving laying the strip-shaped ends on top of each other, inside on inside, nor the butt sealed seam has to be made. The engineering technology is available to join the strip-shaped end to the sheet via a folding edge so that, after preshaping of this folding edge, a folding over of the strip-shaped end onto the sheet outer surface and sealing on is possible without difficulties. After completion of this preparation, the opposite free end of the sheet can then be sealed onto the strip end without difficulties, forming the longitudinal sealed seam. Although the result is a seam in which inside is sealed onto to inside, this seam does not freely project as in the prior art so that there is a danger that might lead to tearing open the internal pressure of the filled product, but the same effect as with the overlapping sealed seam is obtained, since the strip-shaped end has been virtually united with the sheet outer surface by sealing.

The process is further developed according to the invention particularly advantageously in that the shaping of the tube from the separated, flat-lying sheet is performed in two stages, the sheet being conveyed from its first position into a second position, approximately half of it being bent there semicircularly about its longitudinal centre line and conveyed in the second stage into a third position and the remaining portion of the sheet being bent there for completion of the tube. These measures permit the use of favourable machines since the tube is not made in one step as in the case of the previous processes but is shaped in two stages. In the first stage, the sheet is conveyed after separation, while it is initially still flat, to a second position, in which the first tube-shaping stage is provided. In this first stage, approximately a first half, preferably somewhat more than the width of the flat-lying sheet, is bent semicircularly, so that virtually one half of the tube is completely shaped thereby. The abovementioned strip-shaped end may, however, even in a different embodiment, lie in precisely one half of the width of the flat-laying sheet because the opposite end, which is sealed onto the said strip-shaped end, forming the longitudinal sealed seam, forms the same excess on the opposite side. In other words, in the case of this embodiment, the sheet may be divided exactly into two halves, initially the first half being shaped semicylindrically in the first stage and the remaining second cylinder half being formed thereafter in the second stage. Then the tube is complete.

Apparatuses for the production of a liquid package as described in more detail at the start are known. Such apparatuses have a supply roll, conveying mechanisms for the paper web, cutting mechanisms for the separation of the web into sheets, tube-shaping mechanisms and conveying mechanisms for the sheets to further work stations.

These apparatuses operate however, as in the case of the process described, in such a way "from a roll" that the conveyance direction once provided as draw-off direction from the roll is retained until making of the tube, i.e. the paper fibre direction lies in the longitudinal direction of the finished tube. To avoid this in the sense of the object described above, means are provided according to the invention to increase the rigidity of the package and thus improve the seizing by the final consumer.

Furthermore, parts of the apparatus are created according to the invention with which favourable measures can be created in spite of the increased rigidity of the separated sheet and of the tube to make satisfactorily firm and economically producible longitudinal sealed seams at a high throughput.

The object explained above is achieved with regard to the apparatus of the invention in that an elongated mandrel reaching from a second position into at least a third position in the conveyance direction of the sheet is provided horizontally and in that folding levers, areally embracing the mandrel, are provided rotatably driven about axes. The advantages of the first measure, in which the conveyance direction of the paper web, which lies flat before separation, runs virtually transverse to the general conveyance direction of the production machine, have already been described (transversely-lying paper fibre directions higher rigidity upon seizing of the liquid package).

The making of the novel longitudinal sealed seam is performed according to the invention by the mandrel which is arranged horizontally in the conveyance direction of the sheet. In the case of a preferred embodiment, this is a mandrel about which folding levers are arranged to be movable in such a way that the sheet initially lying flat underneath the mandrel can be laid areally onto the mandrel surface. The cross-section of the mandrel may be polygonal or round in this instance. Generally, the mandrel, like the preferred embodiment of the tube as well, will have an outer surface shaped like the outer surface of a cylinder. This also goes for further explanation of the invention, even if a configuration which is quadrangular or rectangular in cross-section is similarly conceivable. The measures according to the invention are independent of this.

In the first stage, the strip-shaped end can be made with the aid of the mandrel for preparation of the longitudinal sealed seam and thereby sealed onto the tube-shaped sheet outer surface so that a smaller, movable part of the pressure jaws, compared with the stationarily fixed, non-moving mandrel, carries out the folding over of this strip-shaped end. If, thus, in the first stage, the mandrel is used not only for half-shaping the sheet into the tube but also for sealing the strip-shaped end onto the neighbouring paper outer surface alongside the folding edge, a conveyance is performed into the second stage, the tube being pushed along on the mandrel. Here the already preshaped tube half is held by a folding lever, areally embracing the mandrel, and an oppositely arranged folding lever then forms the second half of the sheet in the shape of a tube. Directly after this formation, the free end of the sheet is sealed over the sealed-on strip-shaped end, i.e. over the thick ridge formed thereby. For this purpose it is expedient that the two folding levers do not embrace the, for example cylindrical, mandrel by a full 360° but maintain a distance from each other in the region of the thickened ridge (strip-shaped end) into which a heating stamp can enter and ultimately complete the longitudinal sealed seam.

The further preferred embodiment of the apparatus for the production of the liquid package described above is characterized in that a folding lever in the second position, areally embracing the mandrel, is provided rotatably driven about axes and two opposite folding levers in the third position, likewise areally embracing the mandrel, are provided rotatably driven about an axis.

It has already been mentioned that the cross-section of the mandrel may be polygonal or round, it also being possible for the lid to be polygonal or round in plan view. Particularly prefered is the embodiment in which the mandrel is of substantially tubular design. Such a configuration even permits the gusseted square bottom closure at one end of the tube and the moulding on of a round or polygonal lid at the other end of the tube. Moreover, many mechanical engineering advantages arise if the crosssection of the lid is round, preferably circular.

It is particularly expedient according to the invention furthermore if, in the second position, the cutout of the mandrel takes up less than a quadrant in crosssection and receives at least a portion of the pressure jaw, approximately sector-shaped in cross-section, if the pressure jaw is rotatably driven about a longitudinal outer edge of the mandrel and if a heating jaw is provided radially to the longitudinal outer edge and is movable away from the latter. The first half mentioned of the initially flat-lying sheet of coated paper is folded over by means of folding levers in such a way that a folding edge comes up against the said longitudinal outer edge of the mandrel. The strip-shaped end then projects from this edge. This end lies slightly angularly on the rotatable pressure jaw, so that a V-shaped channel of obtuse angle is produced, in which the heating jaw can enter and leave easily. Consequently, the surfaces to be sealed to each other can be intensively heated directly and reliably in one operation. Since the pressure jaw is rotatable about this longitudinal outer edge, it can have a pressure-applying effect after it has, namely, folded over the strip-shaped end by 180° and laid it onto the neighbouring sheet outer surface. This produces the sealing on or the making of the thickened ridge.

A favourable further development of the invention is characterized in that the conveying mechanism for the separated paper sheet from the second position into at least one of the subsequently arranged positions has oscillatingly movable transport sleeves on carrier shafts, extending in conveyance direction, and vacuum areas. Such a development of the conveying mechanism is reliable, simple and controllable at high speed, so that the production machine can obtain a high capacity. The paper sheet lays itself onto a hollow shaft, which may simultaneously also have vacuum orifices, can be held in a certain position by switching on the vacuum, processed and then transported on by the moving transport sleeve.

In the case of further advantageous development of the invention, several rows of conveying mechanisms and mandrels are arranged parallel to one another and two separate conveying mechanisms are provided for the paper web, one of which is driven continuously and the other of which is driven intermittently. The parallel connection of operating mechanisms is known per se in many fields. However, in the case of the production of packages at high throughput speed, this has so far been avoided so as not to make the machine too complicated or just two rows have been arranged one alongside the other. In the case of other machines, it has already been considered whether to provide a doubling of the conveying webs after the moulding on. According to the invention, however, the possibility of arranging numerous conveying webs alongside one another is considered from the start. For this purpose, for example, the paper web need only be drawn off the supply roll by a correspondingly longer piece, after which the desired number of sheets are separated by the corresponding number of cutting knives, scissor-like cutting devices or the like and can be moved on in the desired transverse-lying conveyance direction. In the case of such high-capacity machines, a continuous drawing-off of the web is desired, however, especially as this web in some case also has to run through further preparation steps before the separation into paper sheets. For example, a plastic strip may have to be sealed on in the folding region and its application is not performed well intermittently.

The arrangement according to the invention of two separate conveying mechanisms makes it possible to provide a supply loop between the first and second conveying mechanisms, so that the paper web can, with the preparing operating steps, actually be drawn off the supply roll continuously while the separating device can be fed intermittently.

BRIEF DESCRIPTION OF THE DRAWINGS

FIG. 4 shows diagrammatically the most important parts, in particular folding levers with mandrel for the creation of the longitudinal sealed seam with heating jaw pressed on.

DETAILED DESCRIPTION OF THE PREFERRED EMBODIMENT

Figure 1:
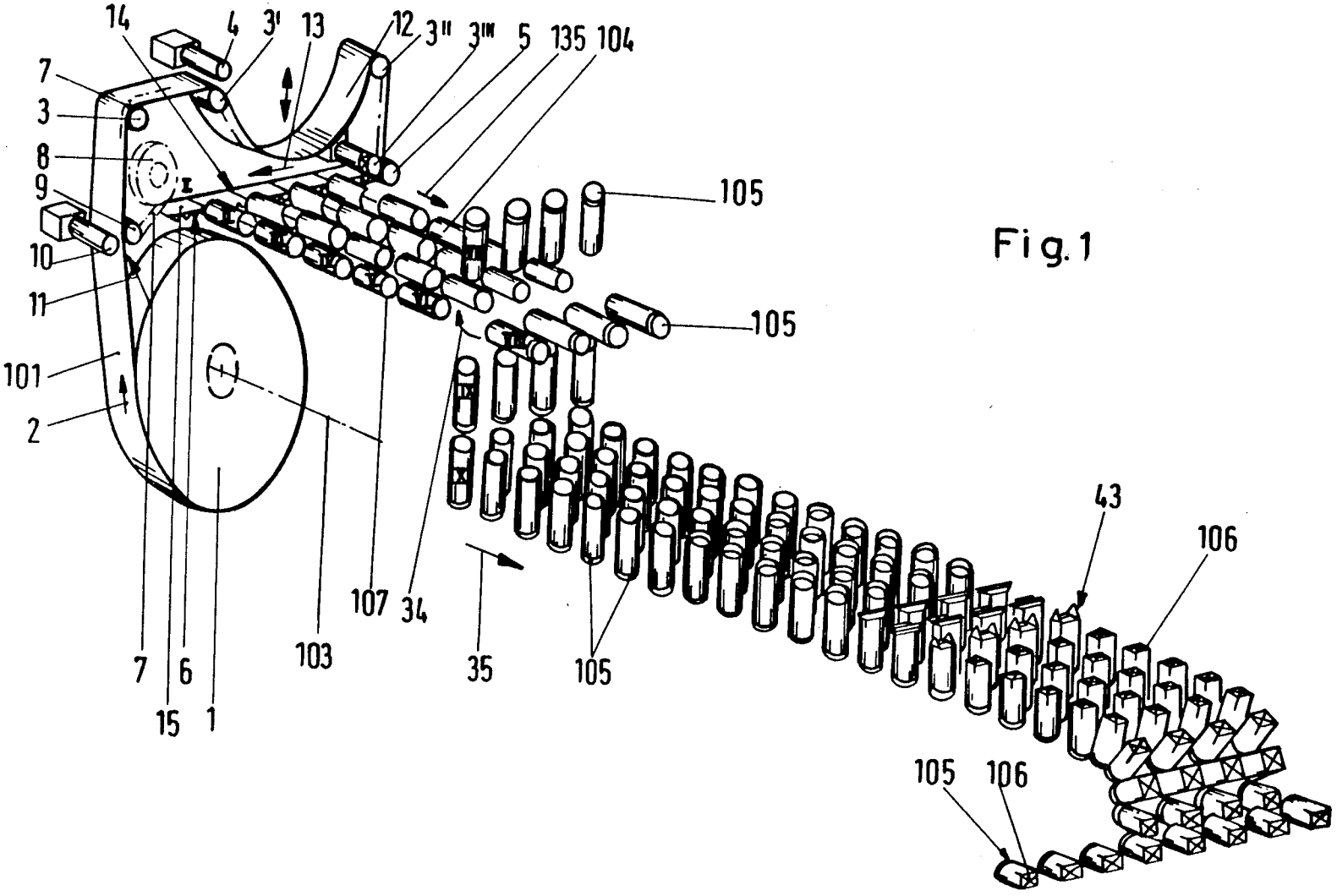
FIG. 1 shows perspectively and diagrammatically the totality of operations from the drawing-off of the paper web to the conveying away of the closed and filled liquid package, FIG. 2 diagrammatically an intermediate state at the first stage of the tube shaping, as is also shown in FIG. 10, the mandrel with cut-out, the pressure jaw and a folding lever being shown.

From the roll 1, the paper web 101 runs in the direction of the arrow 2 via a first deflection roller 3, a second deflection roller 3' with the draw-off roller 4 (first conveying mechanism), a third deflection roller 3'' and finally a fourth deflection roller 3''' with counter-roller 5, the roller 3''' simultaneously being a drive roller which interacts with the driven counter-roller 5. While the drive roller 3''' is intermittently driven, the drive of the draw-off roller 4 is continuous, so that a supply loop 12 is created between the deflection rollers 3' and 3''. This may also move up and down.

In the embodiment shown here, the roller 3''' at the same time bears embossing lines and applies embossing to the one border of the web 101. These embossings can be seen, for example, on the finished web 101 at point 6, where the web 101 lies flat.

To save plastic in those regions in which no or little plastic is necessary, for example in the bottom region where folding and sealing takes place, a pure plastic film strip 7 is continuously applied to the lower border of the web 101, on which the described embossing is then later applied, as shown at 6. This plastic film strip is preferably a polyethylene strip 7 which is drawn off by a roller 9 against a counter-roller 10, the roller 9 being heated by suitable means. Instead of the heated roller 9, a hot-air blower may also be used, which blows hot air into the gap between the roller 9 and the web 101 to be coated, according to arrow 11.

The drive roller 3''' with the counter-roller 5 thus pushes the web 101 intermittently according to arrow 13 at quite high speed forward over a distance of four cylinders. Then the web 101 is brought to a standstill. At four points, one of which is denoted by 14 in FIG. 1, the web is cut to separate into paper sheets 15. For this purpose, for example, a web section or a sheet 15 lies flat in position I.

Figure 6:
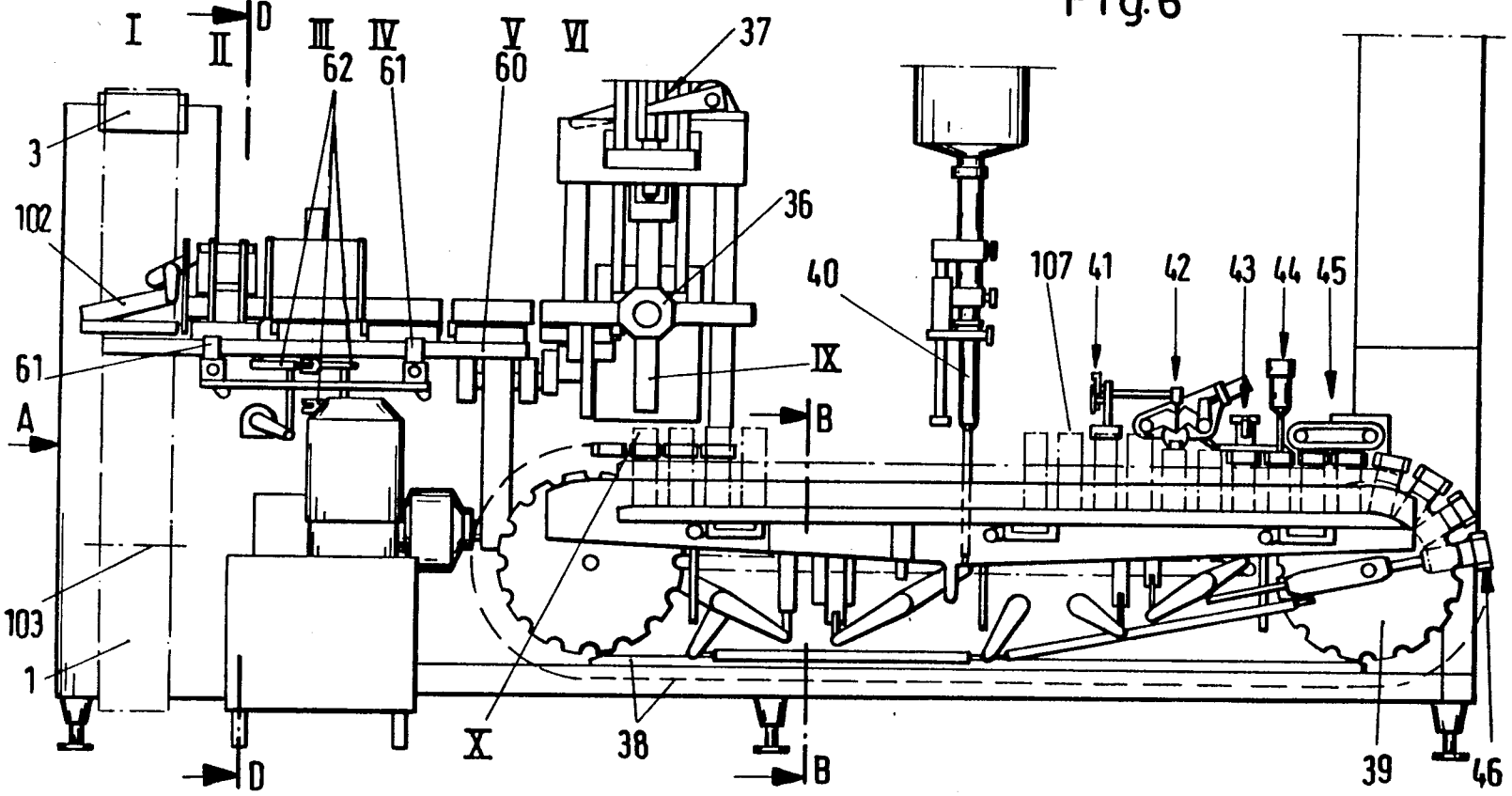
FIG. 6 shows a more precise side-view of the entire machine with the individual work stations.
Figure 7:
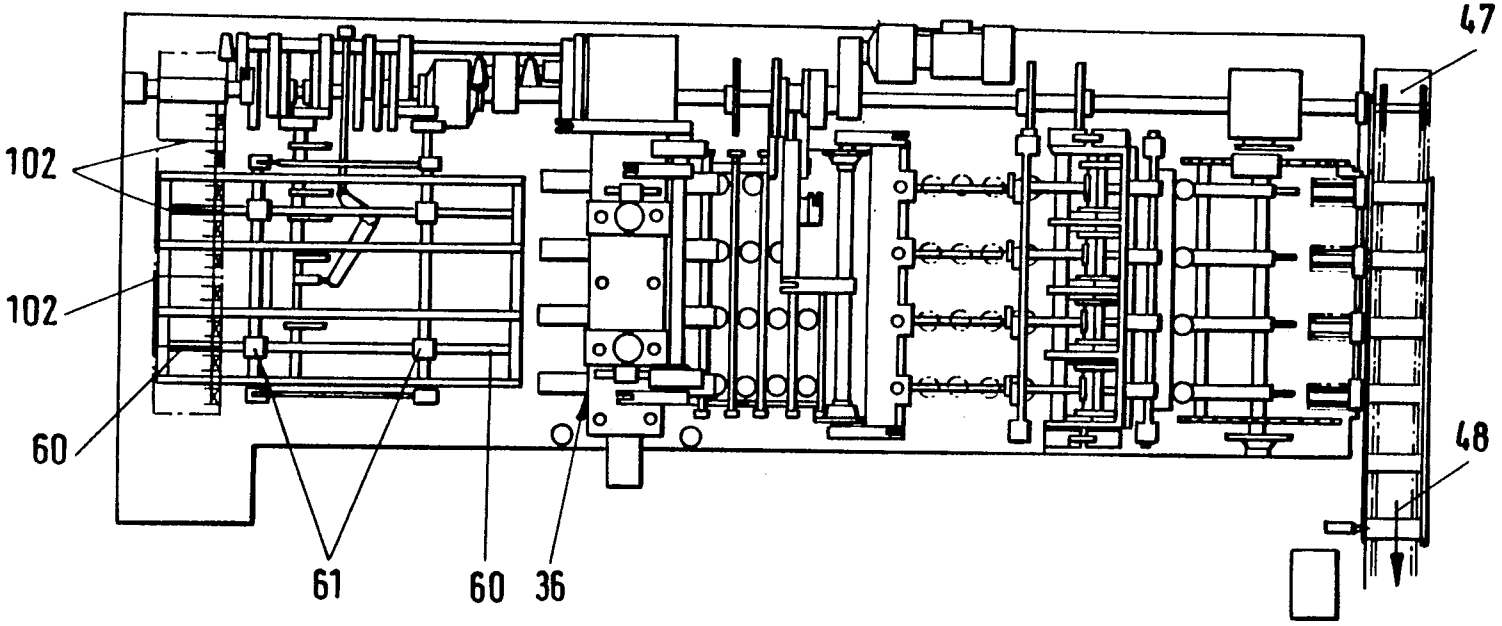
FIG. 7 shows a plan view of the machine according to FIG. 6.

For completion of the diagrammatic FIG. 1, a glance may be taken at FIGS. 6 and 7, in which likewise the supply roll 1 with its axis 103 and the first deflection roller 3 are shown. The fixed lower knife and the driven upper knife, i.e. the cutting mechanism generally denoted by 102, can be seen. Roman numerals are shown above the respective positions so that it can be seen how the sheet 15 can be transported in conveyance direction 135 (FIG. 1) from position I to position IV, to then be pushed onto the mandrel wheel 36 in position V. In FIG. 7, the number of knives 102 and the four mandrel wheels 36, arranged alongside one another, can be seen.

Figure 2:
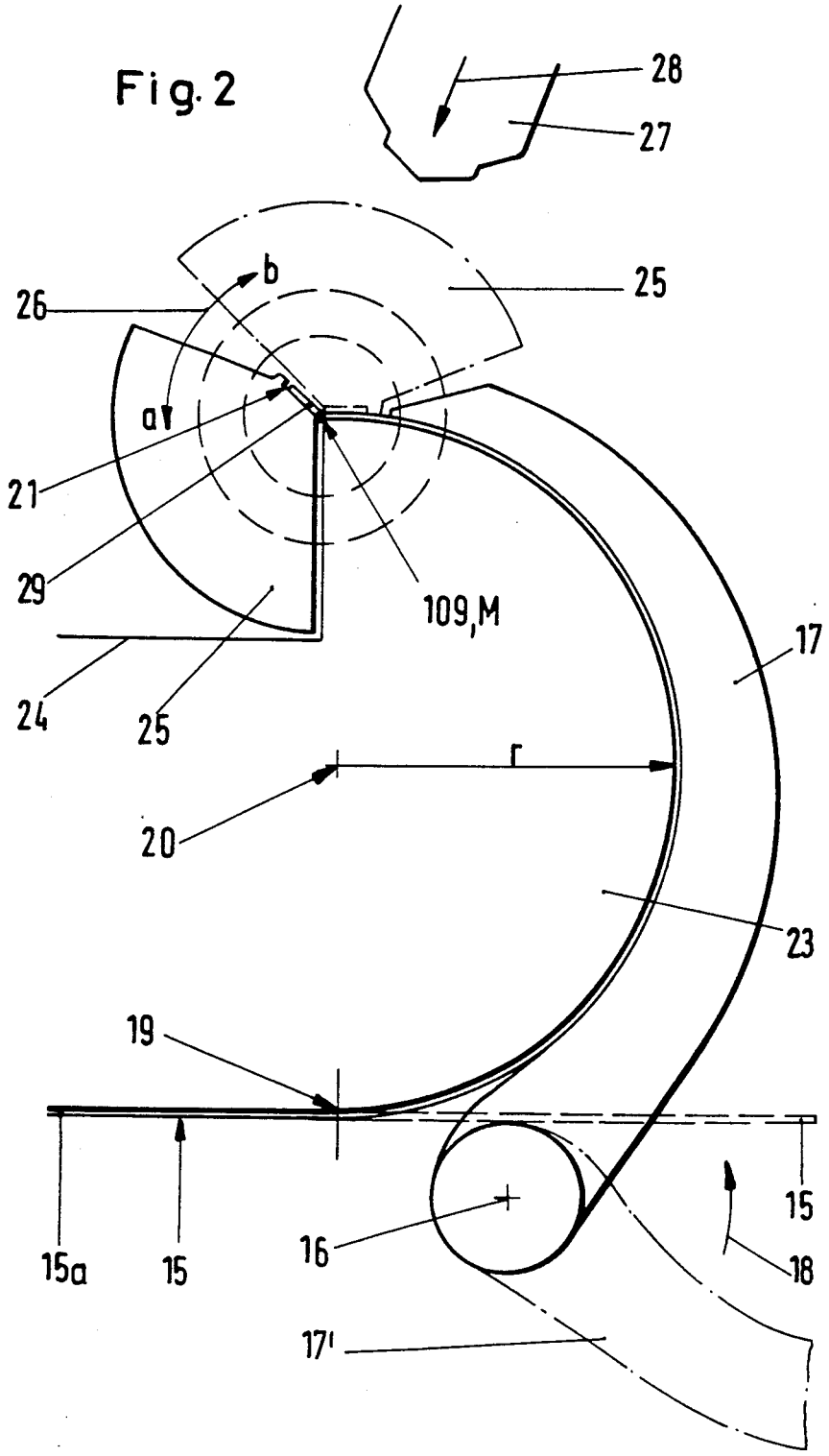

Before the further work stations are described, let us turn to FIG. 2. This shows how a roundness is shaped from the flat web portion 15. Similarly, a quadrangle could also be shaped, but here the preferred embodiment of the tube with outer surface in the shape of the outer surface of a cylinder is described. Initially, the web section (sheet) 15 lies flat above the fulcrum or the axis 16 for the folding lever 17. This folding lever 17 is initially located in the lower position 17', indicated by broken lines, and is moved upward in the direction of the arrow 18 into the position shown by solid lines. In the course of this movement, it takes the flat-lying portion of the sheet 15, shown in broken lines, up with it, in this case the right half of the sheet 15 being concerned and the middle between right and left halves being denoted by 19. This right half of the sheet 15 then runs semicircularly about the centre point 20 with the radius r.

The end of the web, i.e. the end edge of the sheet 15, reaches as far as the pint denoted by 21.

Figure 10:
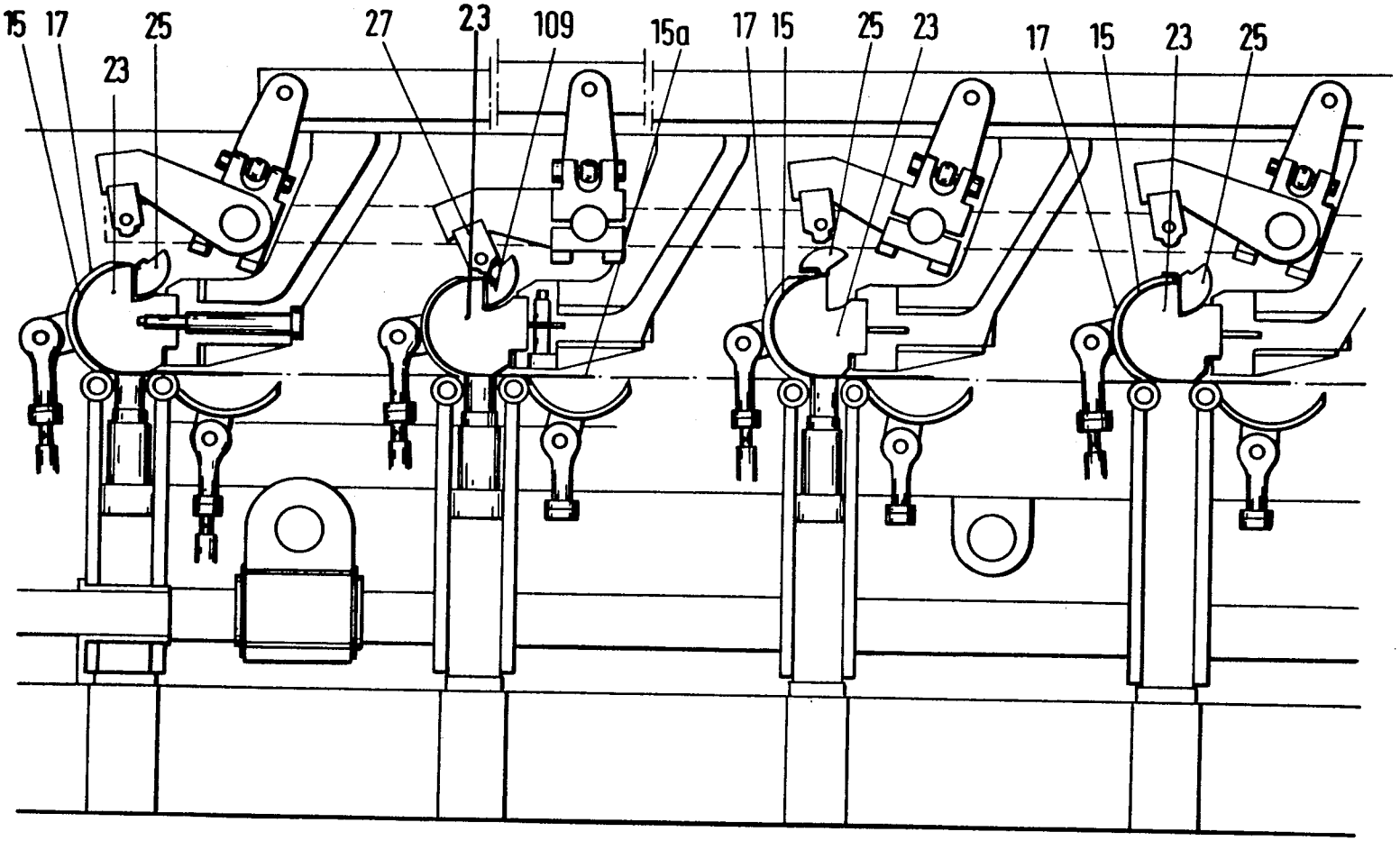
FIG. 10 shows a view along the line of intersection D—D in FIG. 6.

In FIG. 2, just as in FIG. 10, the position II is shown. The difference between FIGS. 10 and 2 is merely that the control mechanisms for the individual parts, such as for example heating jaw 27, pressure jaw 25, folding lever 17 etc. are shown in more detail in FIG. 10. Furthermore, it must be noted that the half-shaped tube is viewed from the opposite direction in FIG. 10 to that of FIGS. 2 to 5.

The shaping and sealing operation can be explained more clearly with reference to FIGS. 2 to 5.

In position II of FIG. 2, there is a first phase a and, after the folding-over of the strip-shaped end 29 onto the neighbouring sheet outer surface, the phase b. The rotationally movable pressure jaw is rotatable to and fro in the direction of the double-headed arrow 26 about the point M, which represents the longitudinal outer edge M of the mandrel 23. The cut-out 24 in the mandrel 23 can be seen in one quadrant of the representation of FIG. 2. Located in this cut-out 24 is the pressure jaw 25 mentioned, of sector-shaped configuration, which moreover also extends however along the tube in the region of position II.

Figure 3:
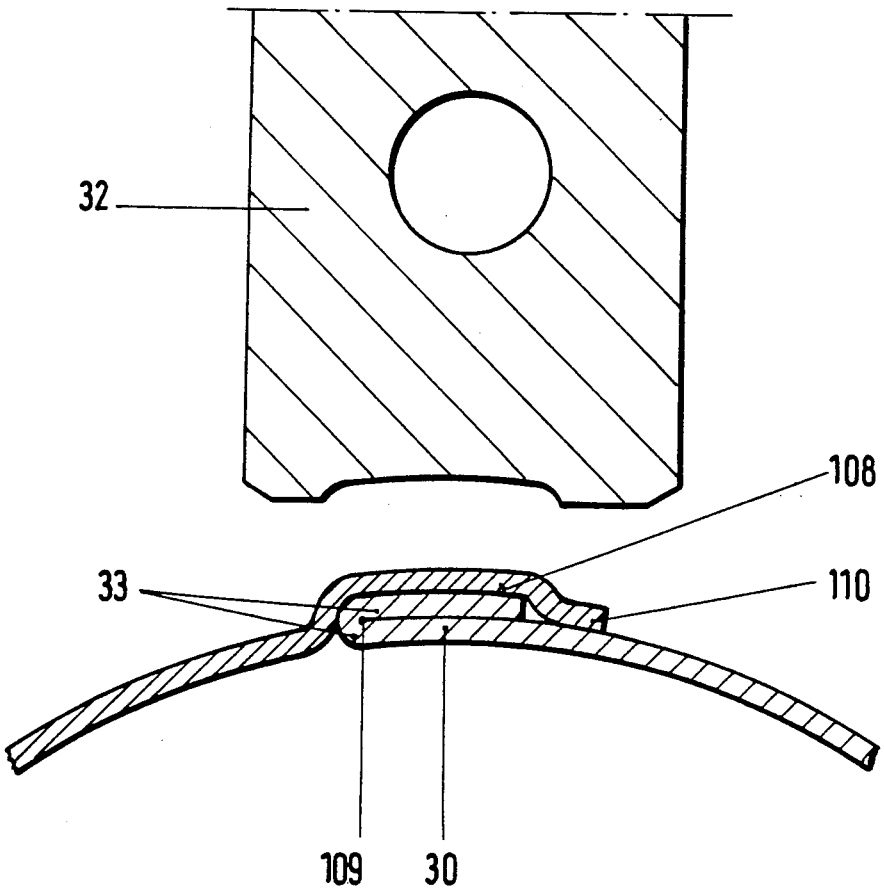
FIG. 3 shows a broken-off cross-sectional view through the tube with finished longitudinal sealed seam on greatly enlarged scale with heating jaw alongside for the longitudinal sealing.
Figure 5:
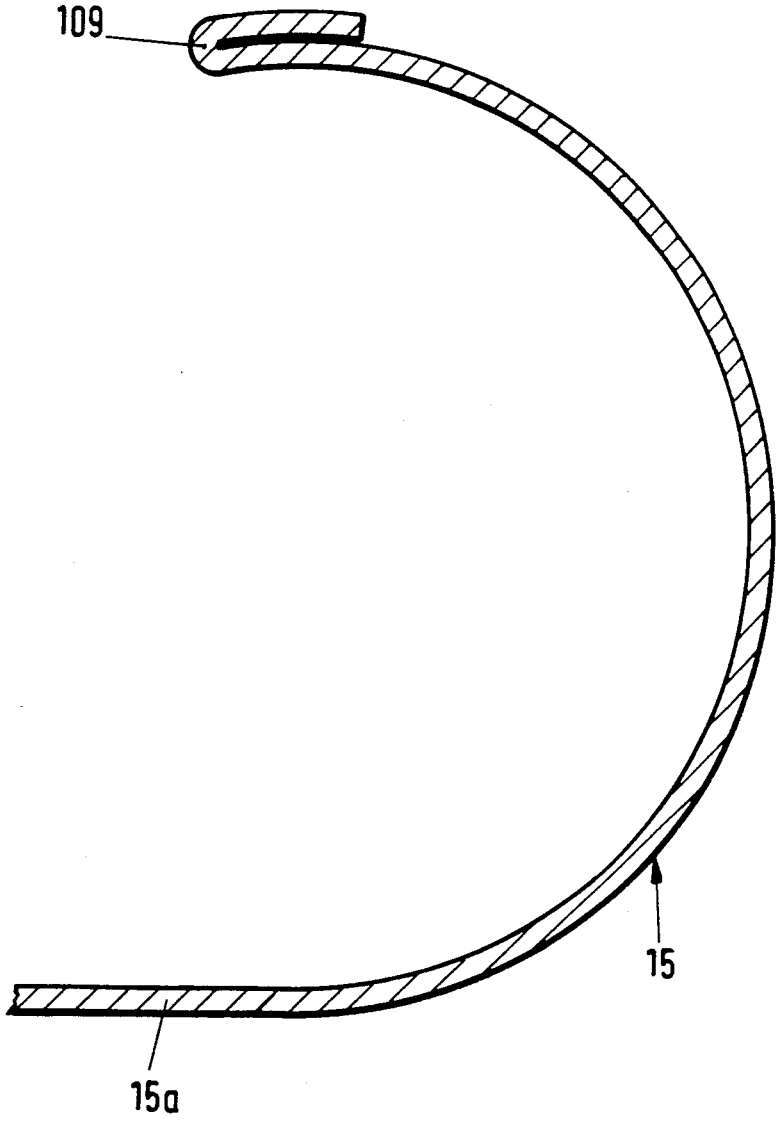
FIG. 5 shows diagrammatically a cross-sectional view of the half-shaped tube with sealed-on strip-shaped end (making of the thickened ridge) after the first tube-shaping stage.

The free end or the free edge 21 of the bent-over sheet 15 or of the strip-shaped end 29 lies somewhat outside—to be precise protruding beyond the centre line M—and lies on the pressure jaw 25, which is in the initial phase a. In this phase, the heating jaw 27 comes down from above in the direction of the arrow 28, preshapes the paper in the region of the longitudinal outer edge M and simultaneously heats the plastic coating outside on the surface of the paper on one side, on one, namely the outer surface. Immediately after retraction of the heated jaw 7 in the direction opposite direction 28, namely back into its initial position, the pressure jaw 25 pivots out of phase a according to arrow 26 upwards to the right into phase b. In the course of this movement, the pressure jaw 25 takes the strip-shaped end 29 of the sheet with it, presses it firmly onto the opposite side and seals the two surfaces under pressure. The state of the half-finished tube according to the representation in FIG. 5 is thereby achieved. In FIG. 3, the portion just completed is denoted by 30.

Thereafter, the pressure jaw 25 moves back again according to the double-headed arrow 26 downward into phase a.

Then the conveyance or the feed of the paper sheet 15, which is folded semicircularly, is performed on the mandrel 23 into the position III denoted in FIGS. 1 and 6. It goes without saying that the operation just described is performed simultaneously with four web blanks or sheets 15.

Figure 4:
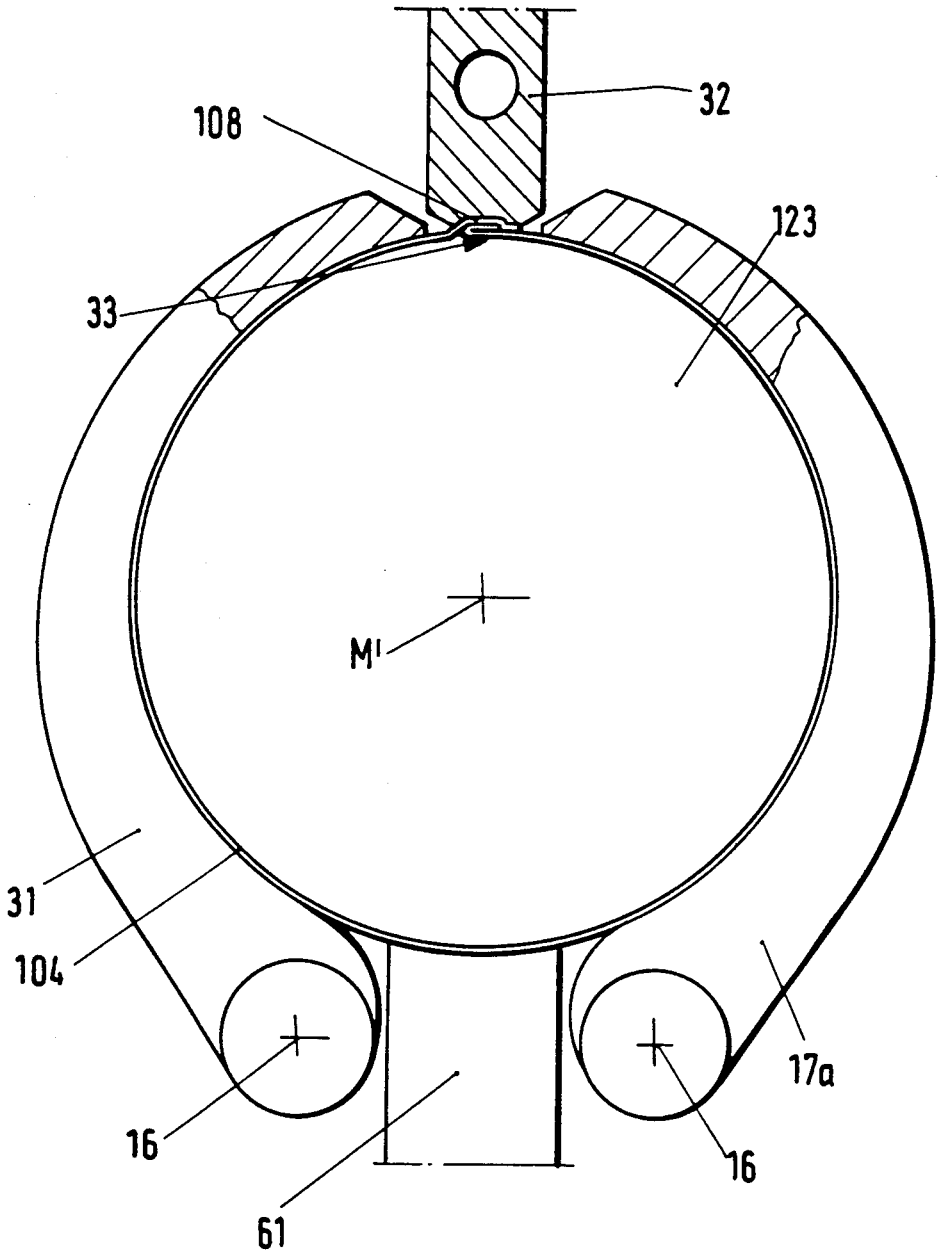

FIG. 4 shows the phase III mentioned. A similar folding lever 17*a* can be seen on the right-hand side and the opposite folding lever 31 on the left-hand side; both pivotable about the axes 16 in a similar way to that described in the case of folding lever 17 in FIG. 2. The folding lever 31 begins its action for folding up the remaining portion of the sheet 15*a* according to FIG. 5 in clockwise direction, while the folding lever 31 also rotates about its axis 16 in anti-clockwise direction. This web section 15*a* is thus folded up and likwise folded over semicircularly so that the cylinder with its centre point M' (FIG. 4) is completed. In this phase, a heating stamp 32 is brought up and seals the border, shown in exaggerated size at the top right of FIG. 3, or the free end 110 onto the thickened ridge 33. Thus the tube is closed, as shown in the region of the longitudinal sealed seam 108 in FIG. 3.

Figure 8:
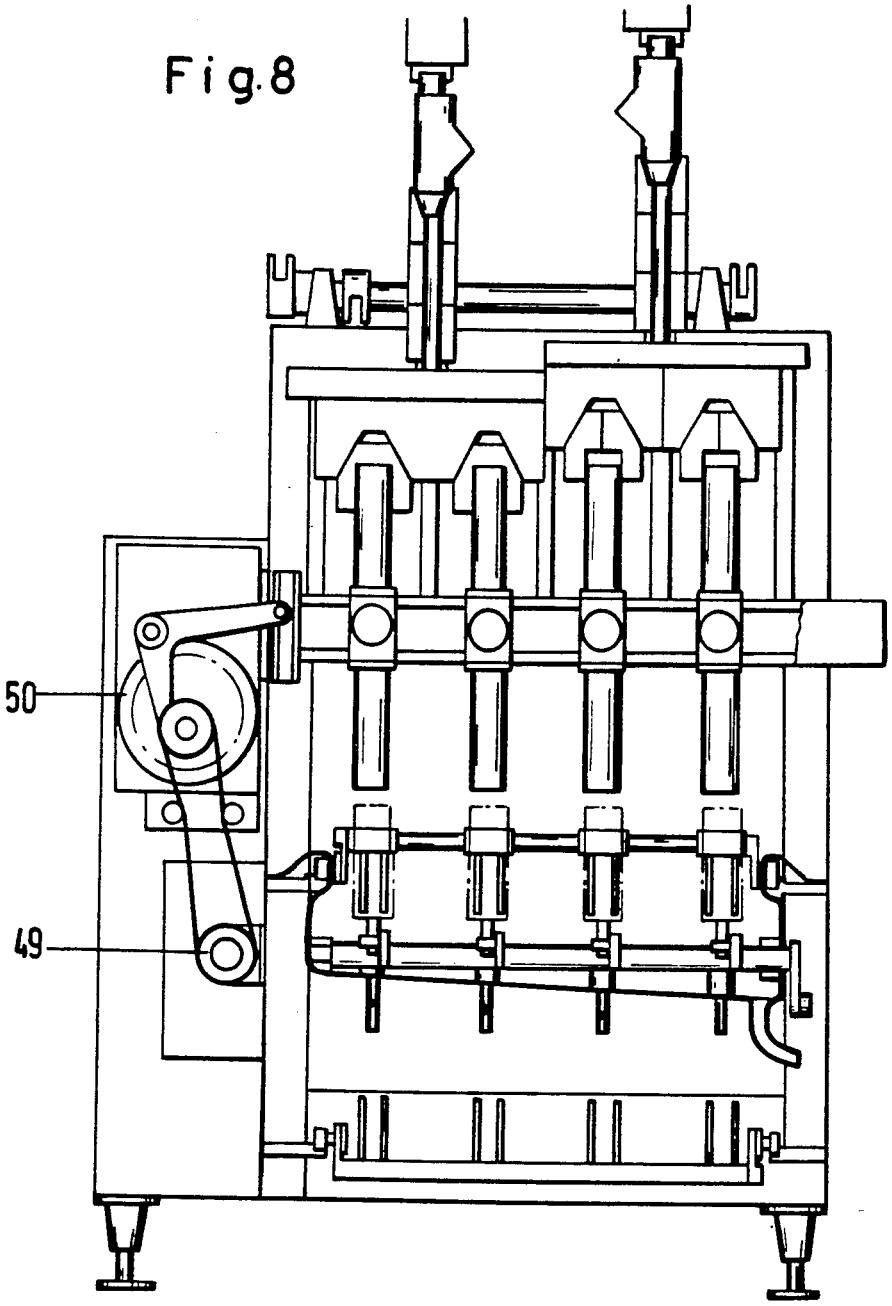
FIG. 8 shows a side-view of the machine, if the view is taken in FIG. 6 from left to right according to arrow A.

There then follows the feed by means of the transport sleeve 61 with vacuum orifices into position IV. The transport sleeve, also shown in FIGS. 6 and 7, is movable vertically a little and mainly in the direction of the axis M'. In position IV, a cooling of the sealed seam is performed. The advancement of the half-finished and then fully-finished tube from position II to position III, thereafter into positions IV and V is always performed in the same cycle, on the mandrel 23 and sucked against the oscillating transport sleeve 61. Cooling may also be provided in position V. On the other hand, however, other manipulations may also take place here which are still necessary on the cylinder-shaped tube, such as for example embossing, impressing or perforating. The diameter of the mandrel 23; 123 decreases a little from position IV to position V, for example by ½ mm. After perforating, the further conveyance into position VI is performed. Here the cylinder is pushed onto one of the four multipart mandrel wheels 36, which are shown in FIGS. 6 to 8.

The mandrel wheel is represented in FIG. 1 merely by a circle, so as to be able to represent the operating function more clearly. The rotational direction 34 of the mandrel wheel can be seen. Its movement in the direction of arrow 34 makes the tube move into the vertical position VII. There the lid 105 is moulded on by an injection mechanism 37 shown in FIGS. 6 and 7.

In position VIII, a cooling is performed and, after further rotation by 90°, the cylinder is again pushed out of position IX into the vertical and from there into position X downward onto a transport chain 38 (FIG. 6), which advances the rows of tube portions 104 at an even rate in the direction of the arrow 35.

In FIG. 6, the stripping position from position IX to X can also be seen, with the transport chain 38 and the two deflection chain wheels 39.

The filling mechanism 40 is located approximately in the centre between the two deflection chain wheels 39. At the station 41, the height of the package, i.e. the upper edge 107 of the board tube, is brought to a precisely defined and specified height before closure is performed in the station 42. In the station 43, the bottom 106 is folded, forming the triangular tabs which stand upright. This station 43 is likewise shown in FIG. 1.

At 44, the hot-air blowing device can be seen in FIG. 6, for heating the outer surfaces and folding over the triangular tabs onto the bottom 106. This foldingover is performed during further transportation from the point 44 into the station 45 by suitable guide rods. The reference number 45 denotes a travelling pressure station which reaches over at least two rows of packages. This station 45 presses for two cycles at a time, i.e. two successive packages, in order that the pressure time is increased. There is namely no liquid as a counter layer but only a air cushion. In the virtually horizontal direction in position 46 (FIG. 6), the package is then ejected onto a transport chain 47, which takes care of transporting the packages in the direction of the arrow 48 (FIG. 7). The packages are received horizontally on the transport chain 47 in order that a marking for date, price or the like can be applied in the region of the plastic lid. A single marking mechanism suffices to provide all packages with the desired marking on the lid.

In FIG. 8, a representation viewing the machine from the left in the direction of the arrow A in FIG. 6, further details can be seen, for example the drive wheel 49 and the cam shaft 50. These are relocated to the side of the machine to increase ease of servicing, in order that each station is well accessible for maintenance work and the like.

Figure 9:
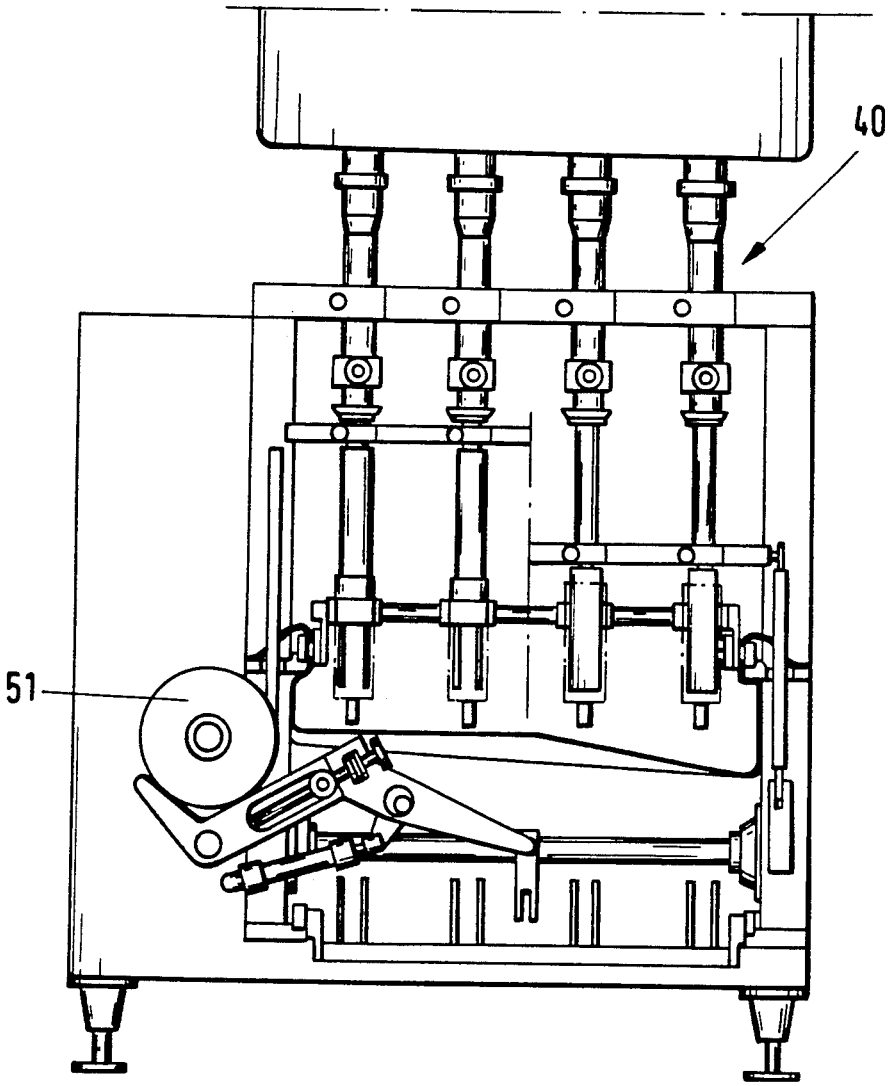
FIG. 9 shows a view along the line B—B in FIG. 6.

For further illustration of the machine, again other parts can be seen in FIG. 9, for example the filling station 40. Here too, a cam shaft 51, for drive elements, can be seen likewise relocated to the side of the machine to keep clear the space for maintenance access of the individual stations. Reference has already been made partially to FIG. 10 in conjunction with FIGS. 2 and 4. FIG. 10 is a sectional view along the line D—D of FIG. 6.

The folding-over operation of the paper sheet denoted by 15 in the first stage (preshaping of the half tube) is performed from left to right. The individual levers, fulcrums and drive mechanisms for the heating jaws, mandrel parts and folding levers are not described in more detail because a person skilled in the art immediately understands these measures when studying FIG. 10. In the position shown at the extreme left, the movable, sector-shaped pressure jaw 25 can be seen in phase a. In the position shown next to it to the right, the heating jaw 27 has entered the channel-shaped groove, this is the heating phase, in which the V-shaped groove is also folded at the strip-shaped end 29. In the third position from the left, the heating jaw 27 has been retracted again. Now, however, the pressure jaw 25 has moved out of phase a in the direction of arrow 26 into phase b. In the position on the extreme right, the release of the semicircularly designed tube away from the paper plane is represented.

The conveying mechanism for the initially flatlying paper sheet 15 from position I into further subsequent positions (for example position II, III, IV, etc.) can be seen from FIGS. 6 and 7. In FIG. 6, the carrier shaft 60 can be seen, on which transport sleeves 61 are carried, which are connected to other transport sleeves 61 via a rod. The drive is performed via the linkage 62. The transport sleeves 61 are moved oscillatingly to the right and left. Furthermore, there are suitable vacuum areas on the shafts for sucking on the respective paper sheet 15. Carriers or grippers, not described in more detail, may support transportation.

We claim:

1. A method for production of containers for packaging liquids, comprising the steps of:

providing a supply roll of a web of plastic-coated supporting material;

drawing said web of said material off said supply roll in a first direction along a web path;

at a first position, cutting said web into sheets, each of said sheets thereby having opposing side edges transverse to said first direction;

conveying said sheets along a transport path from said first position in a second direction transverse to said web path;

at a second position along said transport path, partially shaping each of said sheets into a tube by folding over a first of said side edges through 180° and sealing the resulting folded-over portion to an outer surface of said sheet, and simultaneously bending approximately half of said sheet semicircularly along a center line parallel to said second direction;

at a third position along said transport path, completing shaping each of said sheets into said tube by bending the remaining portion of said sheet semicircularly along said center line to cause said side edges to join, and sealing said folded-over portion onto the opposite of said side edges to define a longitudinal sealing seam for said tube;

molding a plastic lid defining an opening device onto a top end of each of said tubes; and folding and sealing a bottom end of each of said tubes into a quadrilangular bottom.

2. Apparatus for the production of containers for packaging liquids, comprising:

a supply roll supporting a web of plastic-coated supporting material;

first means for conveying said web of said material from said supply roll in a first direction along a web path;

cutting means located at a first position along said web path for cutting said web into sheets such that each of said sheets is provided with opposing side edges tranverse to said first direction;

second means for conveying said sheets from said first position along a transport path in a second direction transverse to said web path, said transport path including a second and a third position of each said sheet;

shaping means for shaping each of said sheets into a tube, said shaping means including an elongated mandrel disposed along said transport path and extending therealong from said second to said third position;

a first axle disposed parallel with said mandrel at said second position;

a plurality of first levers connected to said first axle configured for axially embracing a first half of said mandrel in semi-circular fashion;

a second axle disposed parallel with said mandrel at said third position;

a plurality of second levers connected to said second axle configured for axially embracing a second, opposite half of said mandrel in semi-circular fashion; and means for pivotally driving said axles.

3. Apparatus as defined in claim 2, wherein said mandrel is tube-shaped, and defines at said second position a cut-out portion thereof including not more than one-quarter of the cross-section of said mandrel.

4. Apparatus as defined in claim 3, further comprising a pressure jaw pivotally connected to the outer surface of said mandrel at an edge of said cut-out portion, means for pivotally driving said pressure jaw, a heating jaw disposed adjacent said mandrel at said edge of said cut-out portion, and means for reciprocatingly moving said heating jaw toward and away from said mandrel to heat the portion of a sheet bent about said mandrel adjacent said edge of said cut-out portion.

5. Apparatus as defined in claim 2, wherein said sheet conveying means includes a shaft extending parallel to said transport path, sleeve means slidably mounted on said shaft and means for oscillatingly moving said sleeve means along said shaft, said sleeve means further including means for supplying vacuum to an outer surface thereof for gripping of said sheet.

6. Apparatus as defined in claim 2, further comprising a plurality of sheet conveying means for conveying a plurality of said sheets along a plurality of parallel transport paths, and a plurality of shaping means, one of said shaping means being disposed along each of said transport paths.

* * * * *